US008453920B2

(12) United States Patent
Schemmel et al.

(10) Patent No.: US 8,453,920 B2
(45) Date of Patent: Jun. 4, 2013

(54) CARTON HANDLE WITH BOTTLE NECK AVOIDANCE

(75) Inventors: Garrett K Schemmel, Atlanta, GA (US); Bradford J. Walling, Chesterfield, VA (US)

(73) Assignee: MeadWestvaco Packaging Systems, LLC, Richmond, VA (US)

( * ) Notice: Subject to any disclaimer, the term of this patent is extended or adjusted under 35 U.S.C. 154(b) by 36 days.

(21) Appl. No.: 13/150,595

(22) Filed: Jun. 1, 2011

(65) Prior Publication Data

US 2011/0290867 A1 Dec. 1, 2011

Related U.S. Application Data

(60) Provisional application No. 61/350,424, filed on Jun. 1, 2010, provisional application No. 61/408,545, filed on Oct. 29, 2010.

(51) Int. Cl.
*B65D 5/468* (2006.01)

(52) U.S. Cl.
USPC ..... 229/117.16; 206/427

(58) Field of Classification Search
USPC ..... 229/117.13, 117.16, 117.17; 206/141, 206/143, 427
See application file for complete search history.

(56) References Cited

U.S. PATENT DOCUMENTS

| | | | | |
|---|---|---|---|---|
| 2,284,385 | A * | 5/1942 | Freshwaters | 229/117.16 |
| 3,750,874 | A * | 8/1973 | Detzel et al. | 206/141 |
| 3,904,036 | A | 9/1975 | Forrer | |
| 4,784,316 | A * | 11/1988 | Crouch | 229/117.13 |
| 4,919,266 | A * | 4/1990 | McIntosh et al. | 206/427 |
| 5,197,598 | A | 3/1993 | Stout et al. | |
| 5,246,112 | A | 9/1993 | Stout et al. | |
| 7,775,418 | B2 | 8/2010 | Walling | |
| 2007/0039846 | A1 * | 2/2007 | Spivey, Sr. | 206/427 |
| 2007/0205255 | A1 * | 9/2007 | Dunn | 229/117.13 |
| 2008/0110967 | A1 * | 5/2008 | Walling | 229/117.16 |
| 2009/0032425 | A1 * | 2/2009 | Perkinson | 206/427 |
| 2010/0243721 | A1 * | 9/2010 | Dunn | 229/117.13 |
| 2011/0240725 | A1 * | 10/2011 | Spivey et al. | 229/117.16 |

FOREIGN PATENT DOCUMENTS

| | | |
|---|---|---|
| CA | 1166211 | 4/1984 |

* cited by examiner

*Primary Examiner* — Gary Elkins
(74) *Attorney, Agent, or Firm* — MWV Intellectual Property Group

(57) ABSTRACT

A carton is defined for packaging a plurality of articles. The carton includes a plurality of carton walls at least one of which includes a slot handle that comprises at least one foldable hand flap. The at least one foldable hand flap has an article receiving section for receiving a portion of an article in the carton when the at least one foldable hand flap is folded inwardly of the carton.

15 Claims, 8 Drawing Sheets

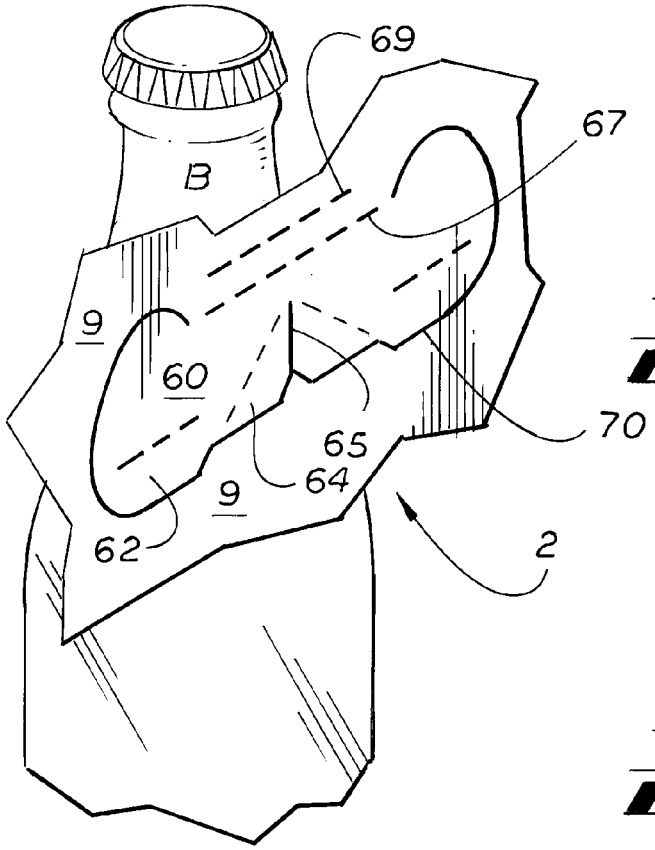
Fig. 5
Fig. 6
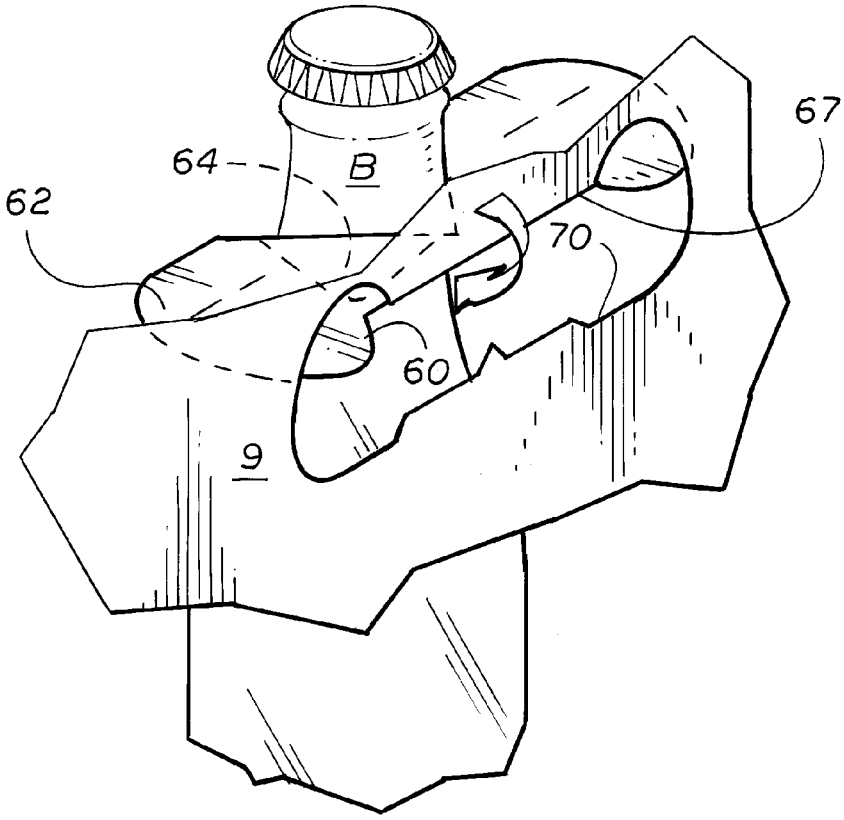

Fig. 8
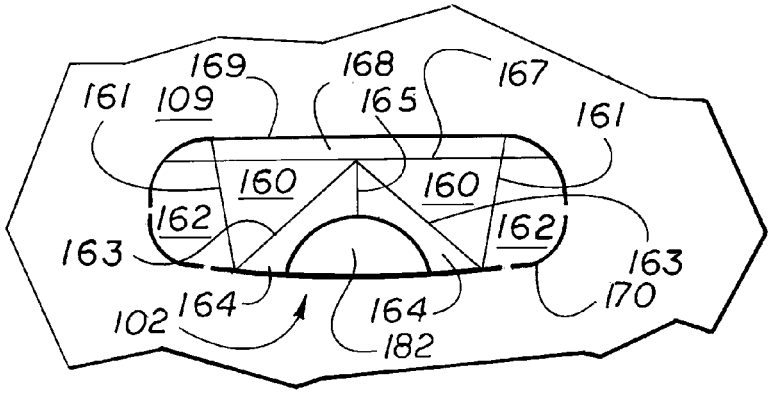
Fig. 9
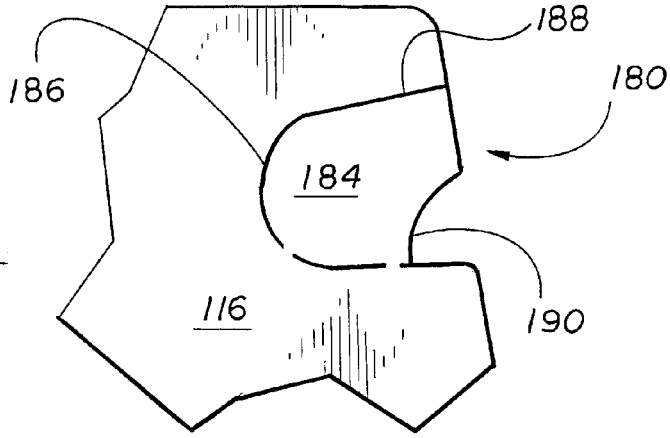
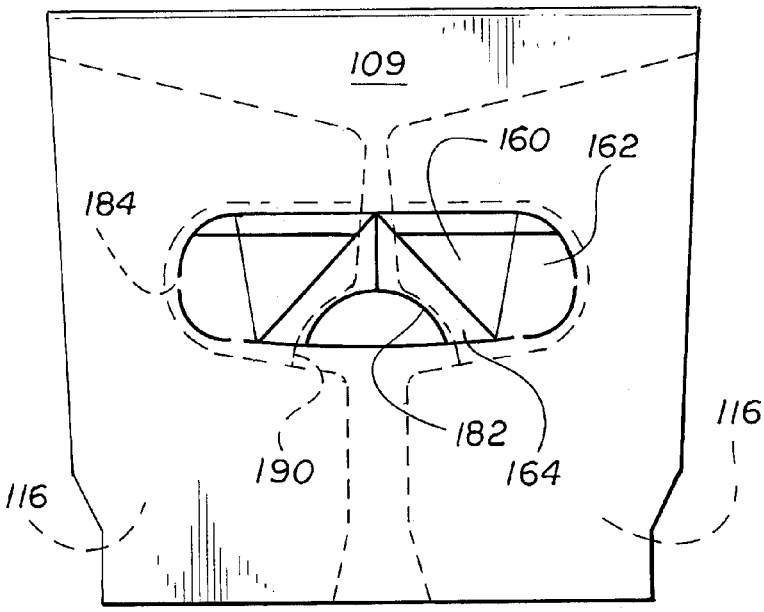
Fig. 10

CARTON HANDLE WITH BOTTLE NECK AVOIDANCE

This application claims the benefit of U.S. Provisional Application Nos. 61/350,424 and 61/408,545, filed Jun. 1, 2010 and Oct. 29, 2010, respectively, and incorporates the same herein by reference in their respective entirety.

BACKGROUND

This disclosure relates to cartons for packaging bottles, which are provided with handle flaps designed to prevent interference with the bottle necks.

U.S. Pat. No. 3,904,036 issued Sep. 9, 1975 and owned by the assignee of this application discloses a fully enclosed bottle carton that includes a so-called false score formed in the bottom wall.

Canadian patent 1,166,211 owned by the assignee of this application discloses a carton for beverage containers which is similar in some respects to the carton disclosed in this application.

U.S. Pat. Nos. 5,197,598 and 5,246,112 owned by the assignee of this application disclose and claim cartons which are directed to the problem of minimizing bottle breakage by imparting an inward taut gripping force to the group of bottles packaged within the carton thereby to minimize the possibility of damage to the bottles due to collisions between adjacent bottles.

SUMMARY OF THE INVENTION

The present disclosure involves slot handles on the end walls of a carton. With such handles, there can be interference between the inwardly displaceable or projectable portion of the handle and the neck of a bottle at the respective end of the carton, so that the handle portion when displaced hits the neck of that bottle. When such a handle is used with a tighter carton, such as a gable-style carton, the handle is located even closer to a bottle than normal, causing an obstruction. This disclosure provides a comfortable solution to such a problem.

The disclosed handle employs a hand flap that has an article receiving section around the middle of that flap. The receiving section may be formed with or without one or more foldable tabs which are foldable around a portion of an article inside the carton, e.g., a bottle neck, which is nearly invisibly to the customer. The receiving section is designed to provide a space for accommodating such a portion of an article so as to prevent interference between that portion and the hand flap when the hand flap is folded inwardly of the carton.

The disclosure provides in one form a carton for a plurality of articles. The carton includes a plurality of carton walls at least one of which includes a slot handle. The slot handle includes at least one foldable hand flap which includes an article receiving section for receiving a portion of an article in the carton when the at least one foldable hand flap is folded inwardly of the carton.

In a preferred embodiment, the carton walls may include a bottom wall, a pair of opposed side walls and a pair of opposed end walls. The at least one of the carton walls may include one or more of the opposed side walls and the opposed end walls.

In another preferred embodiment, the at least one foldable hand flap may include a pair of intermediate panel sections which are hingedly connected to the at least one of the carton wall. The article receiving section may include a pair of yieldable tabs which are hingedly connected to the intermediate panel sections respectively. In such an embodiment, the intermediate panel sections may be hingedly connected to the at least one of the carton walls along at least one fold line. The yieldable tabs may be hingedly connected to the intermediate panel sections along a pair of divergent fold lines extending away from the at least one fold line. Each divergent fold line may be disposed at an angle with respect to the at least one fold line. The at least one fold line may include a pair of primary and secondary fold lines disposed substantially parallel to each other to define a cushion panel therebetween. The yieldable tabs may be disposed next to each other and separated by a severance line. The severance line may be disposed generally perpendicularly to the at least one fold line. Each yieldable tab may have a concaved free edge at a position opposing the respective divergent fold line, and the concaved free edges of the yieldable tabs together may define a cutout for receiving a portion of an article in the carton. Alternatively, the yieldable tabs themselves may define a cutout for receiving a portion of an article when folded along the divergent fold lines with respect to the intermediate panel sections.

In another preferred embodiment, the at least one of the carton walls may include inner and outer overlapping end flaps, and the at least one foldable hand flap may be formed from part of the outer end flaps. In this embodiment, the slot handle may further include least one foldable reinforcing flap formed from part of the inner end flap. The at least one reinforcing flap may be disposed in an overlapping arrangement with the at least one foldable hand flap. The at least one reinforcing flap may have an angled free side edge that is in substantial alignment with one of the divergent fold lines of the yieldable tabs. Alternatively, the article receiving section may further include a cutout defined in the at least one reinforcing flap. In another optional arrangement, the article receiving section may further include a foldable tab hingedly connected to the at least one reinforcing flap. In such an optional arrangement, the foldable tab may be hingedly connected to the at least one reinforcing flap along an angled fold line that is in substantial alignment with one of the divergent fold lines of the yieldable tabs.

BRIEF DESCRIPTION OF THE DRAWINGS

FIG. 5 is a fragmentary perspective view of the slot handle of the carton of FIG. 1, showing the position of the slot handle relative to an adjacent bottle upon formation of the carton and loading thereof with bottles;

FIG. 6 is a fragmentary perspective view similar to FIG. 5, showing the slot handle when pushed inward during use;

FIG. 8 is an enlarged fragmentary view of the slot handle of the blank of FIG. 7;

FIG. 9 is an enlarged fragmentary view of a handle reinforcing arrangement of the blank of FIG. 7;

FIG. 10 is a fragmentary end view of the carton erected from the blank of FIG. 7;

DETAILED DESCRIPTION

Figure 1:
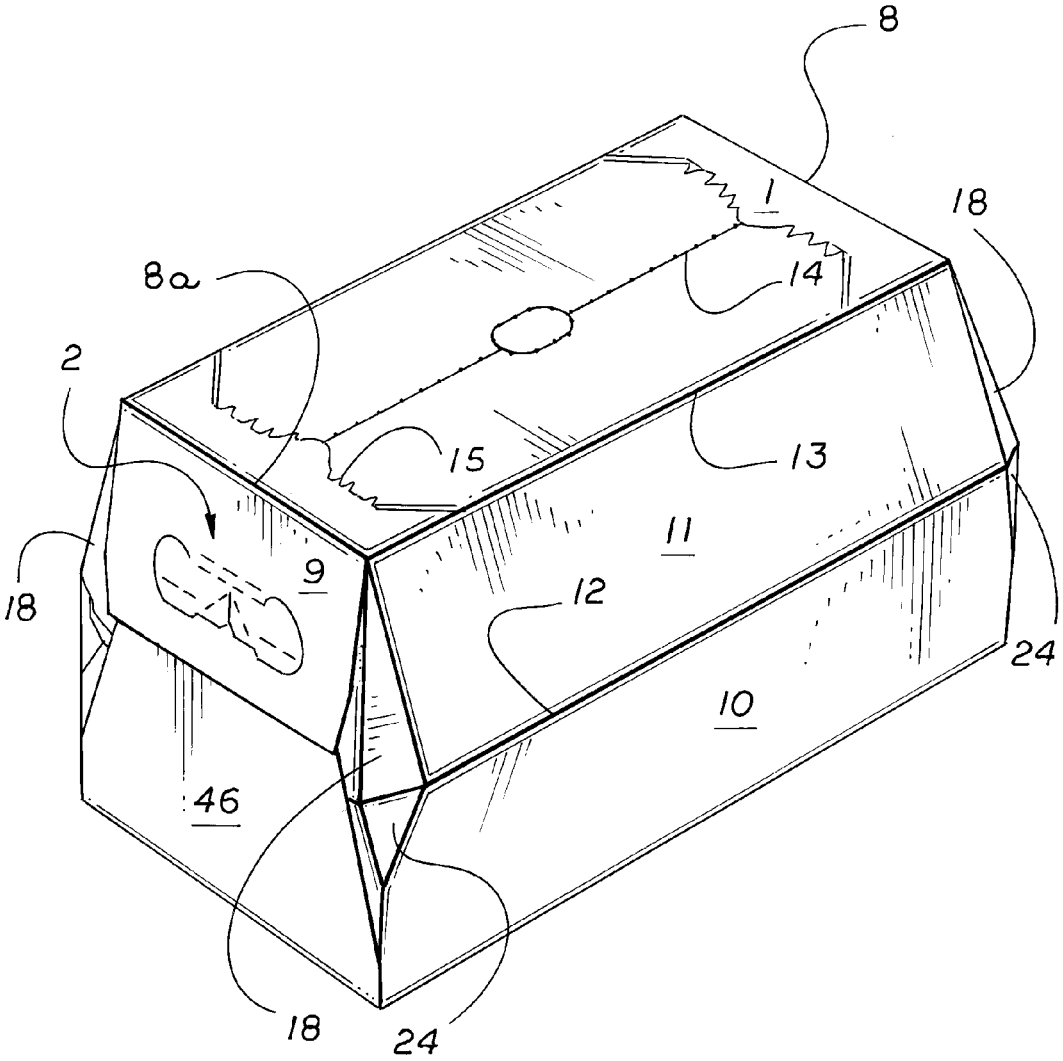
FIG. 1 is a perspective view of a fully set up and enclosed carton of the first embodiment according to the present disclosure.
Figure 2:
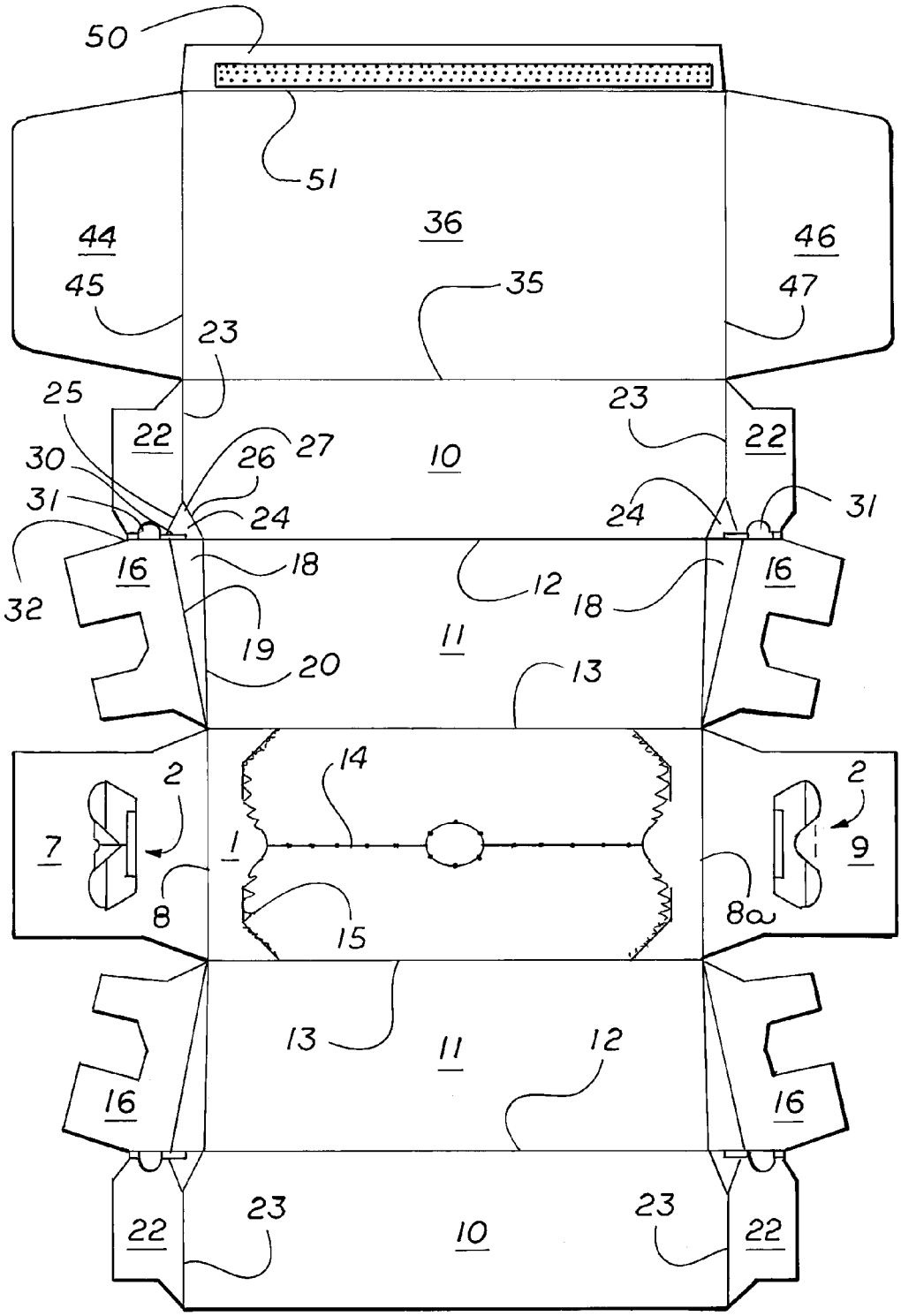
FIG. 2 is a plan view of a blank for forming the carton of FIG. 1, showing the inside surface of the blank.
Figure 3:
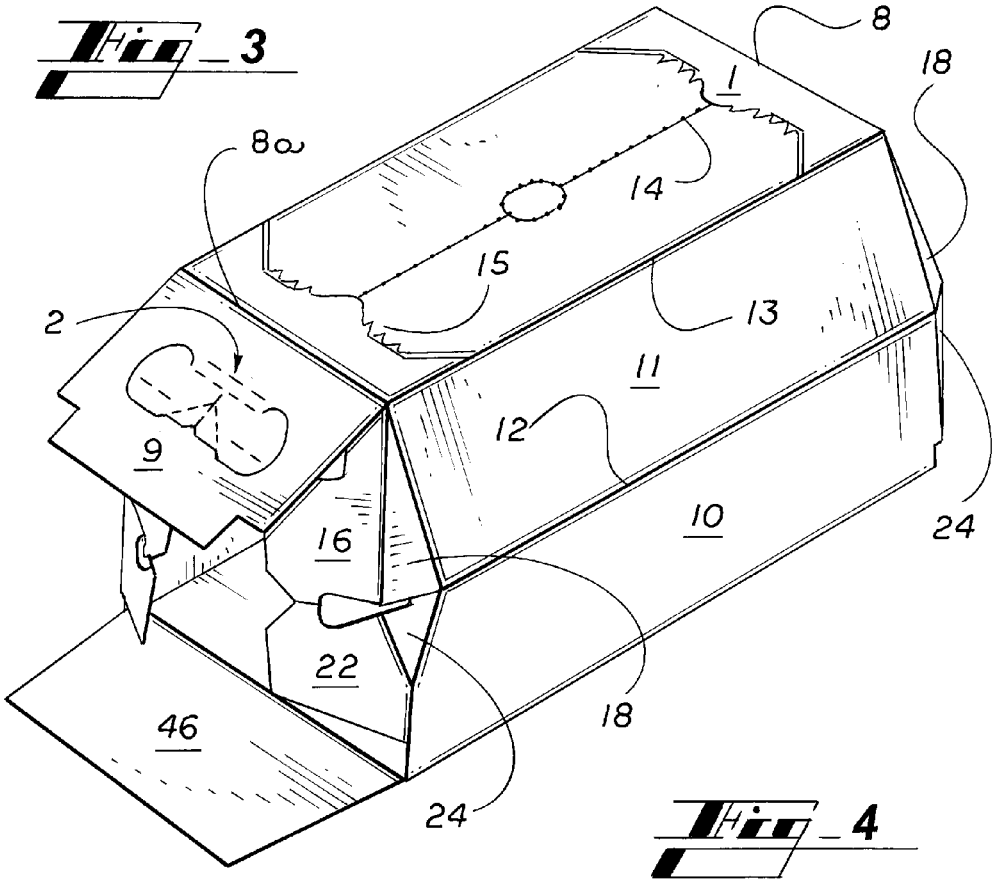
FIG. 3 is a perspective view similar to FIG. 1, showing the rear end of the carton with the end closure panels and slot handle in partially set up condition.

FIGS. 1-6 illustrate a first embodiment of the carton of the present disclosure. With reference to FIGS. 1, 2, and 3, the carton has a top wall 1 foldably connected to top end flap 9. Parts of the carton slot handle structure in top end flap 9 are generally designated by the numeral 2. Top end flap 7 is foldably joined to top wall 1 along fold line 8 and top end flap 9 is foldably joined to top wall 1 along fold line 8*a*.

In the preferred embodiment, the bottom upright portion of each side wall is designated by the numeral 10 and an inwardly inclined top wall portion 11 is foldably joined to the lower portion 10 along a fold line 12 and inwardly inclined portion 11 is foldably joined to top wall 1 along fold line 13. In an alternate embodiment (not shown), top wall portion 11 is not inwardly inclined, but rather is coplanar with lower portion 10. In such a case, fold line 12 may be omitted, and both portions may be formed as a single wall panel.

Conventional tear strips 14 and 15 are struck from top wall 1.

Suitable corner structure formed according to this invention includes an upper side end flap 16. A triangular corner panel 18 is foldably joined to upper section 16 of the side end flap 16, 22 along fold line 19. The triangular corner panel 18 is foldably joined along line 20 to the adjacent end of the inwardly inclined upper portion of one side wall. Fold line 20 is substantially perpendicular to line 12 and substantially vertical when the carton is set up.

A lower section 22 of the side end flap 16, 22 is foldably joined to the lower upright portion 10 of each side wall along fold line 23, Fold line 23 is substantially perpendicular to fold line 12 and is substantially parallel to and offset from fold line 20, and when the carton is set up, is substantially vertical. A lower corner panel 24 is of an inverted triangular configuration and is defined by weakened fold lines 25 and 26 which diverge upwardly from a point 27 on fold line 23. The upper edge of the lower corner panel 124 extending between the fold lines 25, 26 coincides with the lower edge of the upper corner panel 18. A cutaway area 31 helps the adjacent parts of upper and lower corner panels 18, 24 to move into abutment with each other so as to facilitate manipulation of the corner structures during the carton folding and loading operation. As may be necessary to achieve proper folding, cutaway area 31 may extend inwardly completely to fold lines 20 and 26, or may extend only partially thereto as shown. Cutaway area 30 also aids in manipulation of the corner panels during a carton loading operation.

In the preferred embodiment, a bridge portion 32 foldably interconnects upper and lower sections 16 and 22 to assist in folding upper and lower sections 16 and 22 following carton loading, and in maintaining the upper and lower sections 16, 22 in position during subsequent gluing of the carton ends. If desired, however, it is possible to omit bridge portions 32, whereby cutaway areas 31 take the form of notches rather than openings, particularly if cutaway areas 30 extend inwardly only partially toward fold lines 20 and 26.

The angular relationship between the lower section 22 and the lower corner panel 24 is preferable such that the lower section 22 extends inwardly at a right angle to the lower side wall portion 10 and presents a flat and substantially vertical surface for gluing the bottom end flap 46 when the bottom end flap 46 is folded into overlapping face contacting relationship therewith. In addition, lower corner panel 24 helps to maintain the lower section 22 in engagement with the lower portions of the adjacent corner bottles.

Corner structure at the other end of the carton is identical to that just described and includes upper section 16, upper triangular corner panel 18, lower section 22 and lower triangular corner panel 24.

The bottom edge of the lower portion 10 of a side wall is foldably joined to the bottom wall 36 along fold line 35. Openings (not shown) may be formed in bottom wall 36 to facilitate manipulation of the carton during feeding and setting up operations. Bottom end flap 44 is foldably joined to bottom wall 36 along fold line 45 and bottom end flap 46 is foldably joined to bottom wall 36 along fold line 47.

The remaining side wall structure, as well as the corner structures previously described, are identical to those shown in FIG. 2, and thus a detailed description of these parts is omitted for illustration purpose. The same numerals are applied to designate both sets of parts.

In order to interconnect the opposite ends of the blank as shown in FIG. 2 to form a tubular enclosure, lap panel 50 is foldably joined to bottom wall 36 along fold line 51.

Figure 4:
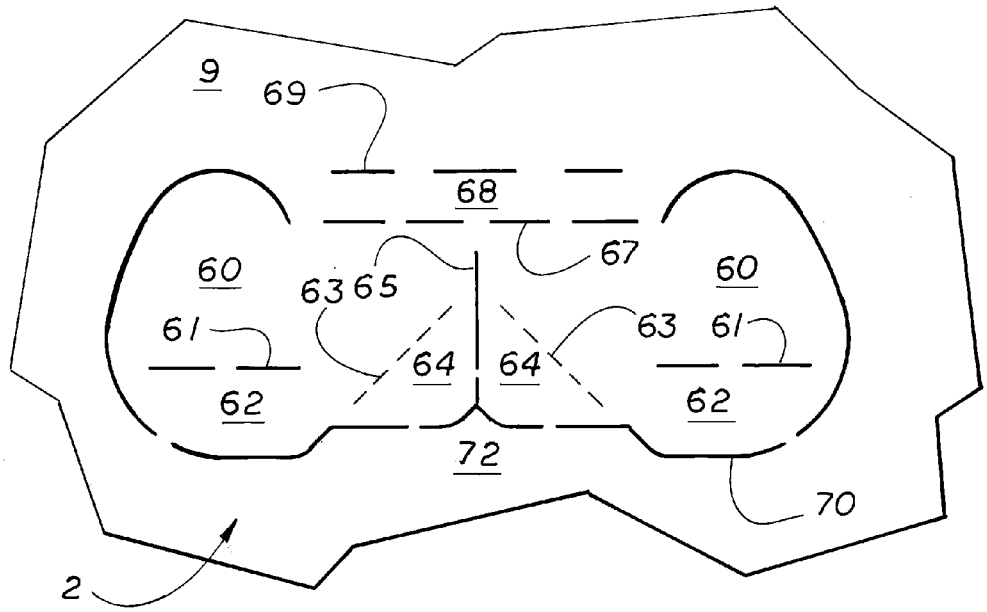
FIG. 4 is an enlarged fragmentary view of the slot handle of the carton of FIG. 1.

In order to set the carton up from the condition shown in FIG. 2 to that shown in FIGS. 1 and 4, an application of glue is made to the lap panel 50 as indicated by stippling in FIG. 2. Thereafter the lap panel 50 is folded along line 51 and attached to the lower portion 10 at the opposite end of the blank.

The carton may then be set up into open ended condition and loaded through one or both ends. The top and bottom end flaps are secured together by glue. The various corner structures are manipulated into fully set up condition and the carton then appears in completed form as shown in FIG. 1.

Access to the contents of the carton may be had by simply rupturing the tear lines such as 14 and 15 to gain access to the packaged bottles. If bottle return is desired, the empty bottles may be reinserted into the carton and returned.

FIGS. 1, 2, and 3 denote slot handle 2 on the top end flap 9. An identical slot handle is located on the other top end flap 7. The slot handle 2 is known as a fully enclosed type, since in the initial configuration, the slot handle 2 forms no aperture in the carton itself. That is, during shipping and handling, the carton is completely enclosed, which is useful for product security.

Referring now particularly to FIGS. 4, 5 and 6, FIG. 4 illustrates in plan view a portion of the top end flap 9 containing the slot handle 2, while FIGS. 5 and 6 are perspective views of the slot handle 2 in proximity to a bottle B within the carton. In FIGS. 5 and 6, a bottle B adjacent to the slot handle 2 is illustrated in partial view to help explain the features of the invention.

Although varied combinations of tabs may be used to form the slot handle 2, a flap including at least four tabs is used in this example of the preferred embodiment. The at least four tabs or a combination of the at least four tabs includes yieldable center tabs 64 positioned between opposing intermediate panel sections 60. The panel section 60 and tab 64 are related by a series of cut and fold lines. The yieldable tabs 64 are hinged by fold lines 63 to the respective intermediate panel section 60. The intermediate panel sections 60 may have an additional end panel section 62 attached by fold line 61, The intermediate panel sections 60 are hingedly attached to the top end flap 9 with primary fold line 69 and secondary fold line 67. Between these fold lines is a cushion panel 68 for providing hand comfort when using slot handle 2. A cut line 70 defines a periphery of each intermediate panel section 60. It should be noted that yieldable tab 64 is not as high as the combined intermediate panel sections 60 and additional end panel section 62, leaving an area 72 outside the periphery of the slot handle. Because of this, when the slot handle 2 is placed into use by folding the handle into the carton, the yieldable tab 64 will not extend as far inward and will have less interference with bottle B within the carton. A severance line or cut line 65 separates the yieldable tabs 64 from one another. For convenience, the perforated fold line 69 connecting the slot handle 2 to the top end flap 9 will be referred to as the primary perforated fold line 69. A second perforated fold line 67 essentially parallel to the primary perforated fold line 69 for convenience will be referred to as a secondary perforated fold line 67.

Referring now particularly to FIGS. 5 and 6, the partially-illustrated bottle B is shown with respect to the slot handle 2. For purposes of explanation and illustration, the bottle B illustrated here may be considered to be aligned directly alongside ("under") the slot handle 2. Referring now to FIG. 5, the yieldable tabs 64 are aligned over the bottle B which lies under the slot handle 2. The yieldable tabs 64 have a generally V-shaped configuration.

To utilize the slot handle 2, the slot handle 2 is pushed through the top end flap 9. Typically this could be done by pressing one's fingers inward on slot handle 2, for example on intermediate panel sections 60 or end panel sections 62, and yieldable tabs 64, The slot handle 2 will then break loose from top end flap 9 along cut line 70. As the slot handle 2 is pushed inward, it generally pivots about the primary perforated fold line 69 and or secondary perforated fold line 67. This brings the slot handle 2 closer to bottle B, and in particular, the yieldable tabs 64 will eventually contact the neck of bottle B. Further pushing inward will cause the yieldable tabs 64 to separate along cut line 65, and fold back toward intermediate panel sections 60 along fold line 63. The yieldable tab 64 thus bends to conform to the neck of bottle B. Maximum bending of the slot handle 2 into the carton is promoted by the secondary perforated fold line 67. It is to be noted that fewer than or more than four or six tabs may be used, however, the invention works very well when at least a portion of slot handle 2 is centered over a neck of bottle B and can yield foldably apart upon contact with neck of bottle B. The particular combination as shown works well because it allows the slot handle to move far enough into the carton to allow an individual's hand to fit under slot handle 2.

FIGS. 7 to 10 show an article carton of a second exemplary embodiment according to the present disclosure. The carton of the second embodiment is similar to that of the first embodiment, with the notable differences between the two embodiments including the panel sequence shown in FIG. 7 and the structure of the slot handle. The second embodiment will be described to illustrate at least those notable differences, In FIGS. 7-10, similar reference numerals have been used to denote like features. For example, the reference numerals in the second embodiment are increased by 100', as compared to those in the first embodiment to show that they represent features of the second embodiment. Since the second embodiment shown in FIGS. 7 to 10 have features common to the first embodiment, differences in those second embodiment will be primarily highlighted. The other features in the second embodiment are common to the first embodiment and thus are denoted by the aforementioned similar reference numerals. Description of those common features will be omitted for the second embodiments since the description of the first embodiment applies also to the second embodiment as far as the common features are concerned.

Figure 7:
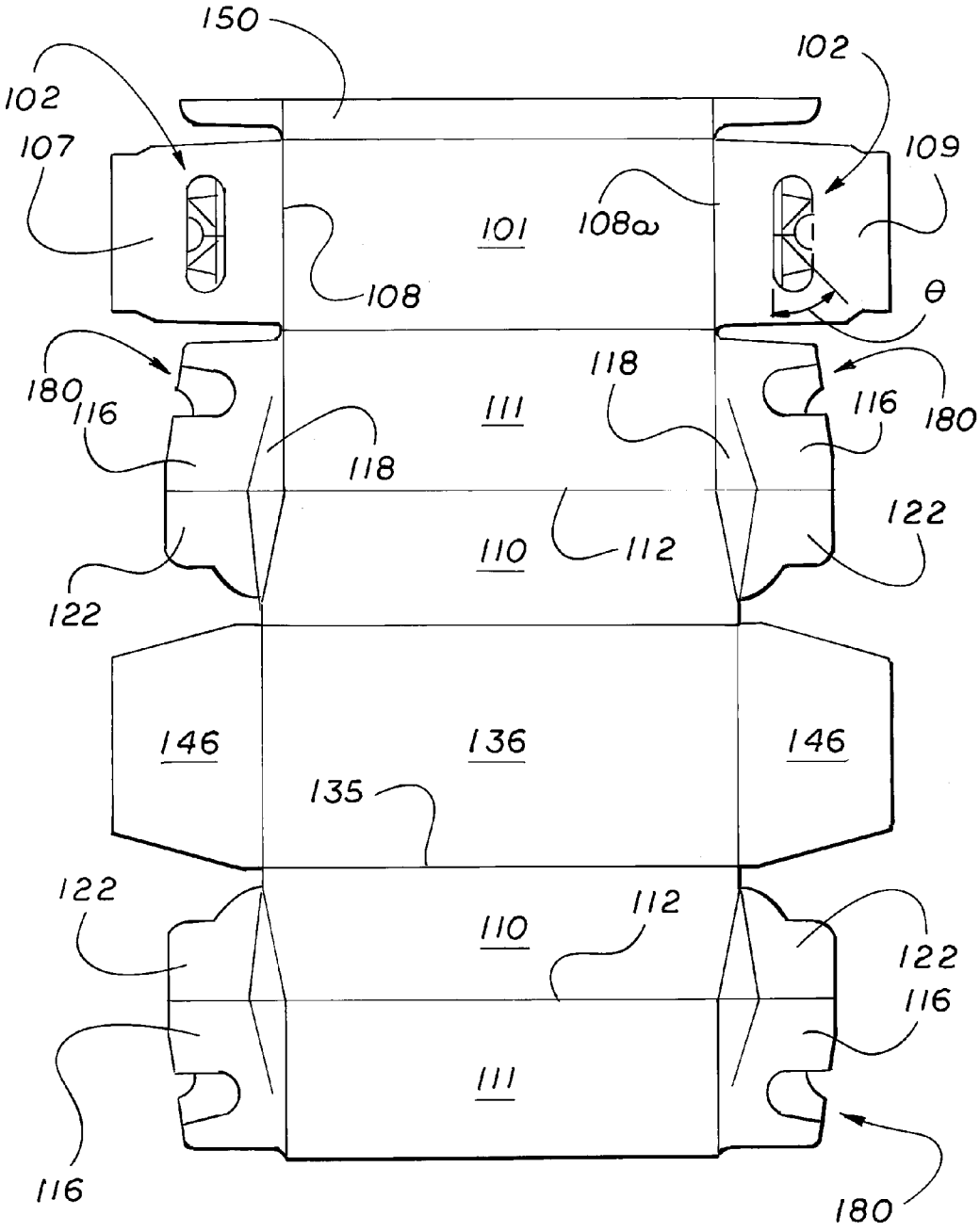
FIG. 7 is a plan view of a blank of a carton of the second embodiment according to the present disclosure.

FIG. 7 shows a blank for forming a carton of the second embodiment. Unlike the first embodiment, the blank of FIG. 7 has its glue panel 150 hingedly connected a top panel 101 that is located at an end of the blank. The top panel 101 is hingedly connected to a first side panel 110, 111 which in turn is hingedly connected to a bottom panel 136. The bottom panel 136 is then hingedly connected to a second side panel 110, 111 that is shown at the other end (i.e., the lower end as viewed in FIG. 7) of the blank.

A slot handle 102 is formed in each of the top end flaps 107, 109. A cooperating handle reinforcing arrangement 180 is formed in each of the upper side end flaps 116, 112. One of the slot handles 102 is illustrated in FIG. 8 in an enlarged form whereas one of the handle reinforcing arrangements is shown in FIG. 9 in an enlarged form.

Referring to FIG. 8, the slot handle 102 includes a hand flap formed from the respective top end flap 109 and hingedly connected thereto along a fold line 169. The opposite ends of the fold line 169 are connected together by a generally C-shaped cut 170 that defines the hand flap in cooperation with the fold line 169.

The hand flap contains a plurality of panel sections divided by a severance line 165 and multiple fold lines 161, 163, 167. The panels sections include a pair of adjoining yieldable tabs 164, 164 separated from each other by the severance line 165. A semi-circular cutout 182 is defined by these yieldable tabs 164. The cutout 182 is provided so that a bottle neck is received in the cutout 182 when the handle flap (102) is folded inward of the carton and the yieldable tabs 164 are pressed against, or otherwise brought into contact with, the bottle neck, The severance line emanates from the cutout 182 and extend upward to its upper end from which a pair of fold lines 163, 163 divergently extend downward toward the lower end of the handle flap. These divergently extending fold lines 163, 163 hingedly connect the yieldable tabs 164 to a pair of intermediate (triangular) panel sections 160 respectively. Each of the divergently extending fold lines 163 is disposed at an angle θ (see FIG. 7) with respect to the fold line. 169. The angle θ is preferably between 30 degrees and 60 degrees and more preferably between 45 degrees and 50 degrees. In the embodiment illustrated in FIG. 8, the angle θ is about 47 degrees. Each panel section 160 is hingedly connected to a respective end panel section 162 along a fold line 161. Each panel section 160 is also hingedly connected to a common cushion panel 168 along a fold line 167 that is disposed substantially parallel to the fold line 169.

Each slot handle 102 cooperate with a pair of handle reinforcing arrangements 180 to provide a handle structure. The handle reinforcing arrangements 180 of each pair are disposed under the respective top end flap 107, 109 when a carton is erected. Referring to FIG. 9, each handle reinforcing arrangement 180 is provided by the upper section 116 of the respective side end flap 116, 122. Each handle reinforcing arrangement includes a reinforcing flap 184 formed from the upper section 116 of the respective side end flap 116, 122. The reinforcing flap 184 is hingedly connected to the upper section 116 along a fold line 188. A generally C-shaped cut 186 and the fold line 188 together define the reinforcing flap 184. A cutout 190 is defined in the reinforcing flap 184.

FIG. 10 shows the top end flap 109 placed over the respective pair of side end flaps 116, 122. The upper sections 116 are shown in the dotted lines since they are placed behind the top end flap 109. The upper sections 116 and the top end flap 109 are arranged in the relationship of FIG. 10 when the blank of FIG. 7 is erected into a carton. As illustrated, the slot handle 102 is in substantial alignment with the pair of reinforcing arrangements 180 while the cutout 180 is in substantial alignment with the pair of cutouts 190. With the panels arranged in this fashion, the reinforcing flaps 184 are capable of being folded inward of the carton along with the hand flap (102). The areas of the reinforcing flaps 184 adjacent to the cutouts 190 may be deformed slightly when the flaps 184 are pressed against, or otherwise brought into contact with, a bottle neck upon inward folding of the hand flap (102). The yieldable tabs 164 of the hand flap are yet folded about their respective fold lines 163 when they are brought into contact with the bottle neck.

Figure 11:
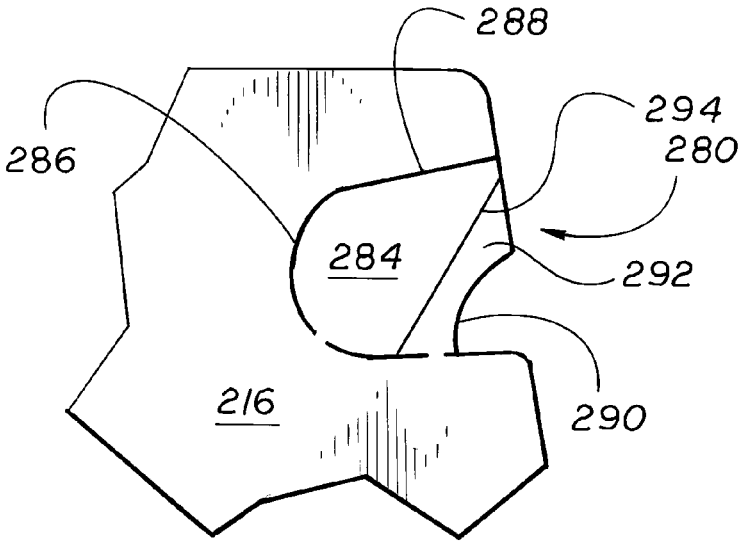
FIG. 11 is an enlarged fragmentary view of a handle reinforcing arrangement of a carton of the third embodiment according to the present disclosure.
Figure 12:
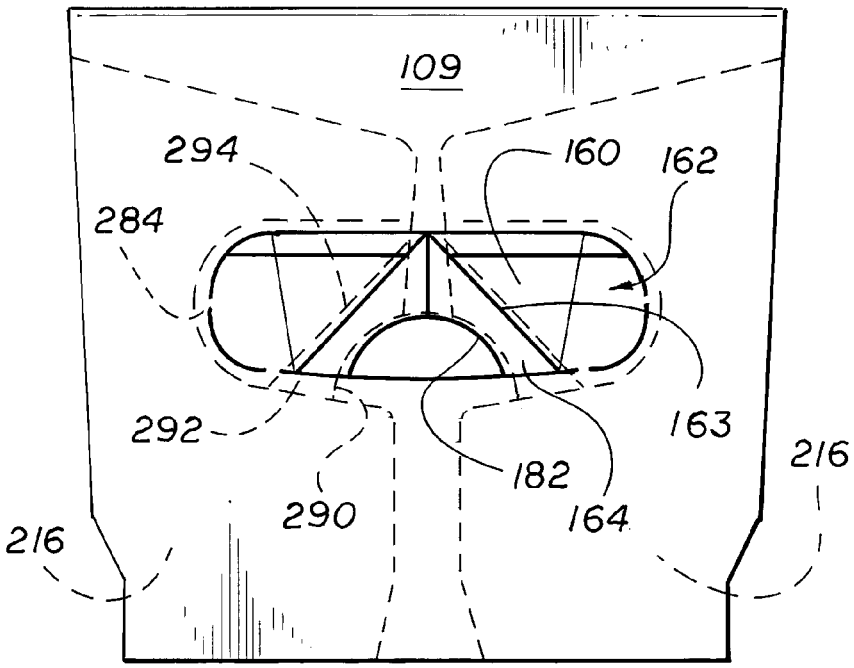
FIG. 12 is a fragmentary end view of the carton of the third embodiment, the carton having been formed using the handle reinforcing arrangement of FIG. 11.

FIGS. 11 and 12 illustrate a third embodiment of the carton of the present disclosure. The third embodiment differs from the second embodiment in that the handle reinforcing arrangements 280 are provided with additional fold lines 294 respectively. The reference numerals in the third embodiment are increased by "200", as compared to those in the first embodiment to show that they represent features of the third embodiment except those features identical to the second embodiment. Those features of the third embodiment that are identical to those of the second embodiments are denoted by the reference numerals identical to the corresponding features of the second embodiments.

Referring to FIG. 11, the reinforcing flap 284 has a foldable tab 292 hingedly connected to the reinforcing flap 284 along an angled fold line 294. The cutout 290 is defined in the foldable tab 292 in this embodiment. Upon assembly of a carton, the angled fold line 294 is placed in substantial alignment with the divergent fold line 163 as shown in FIG. 12.

Figure 13:
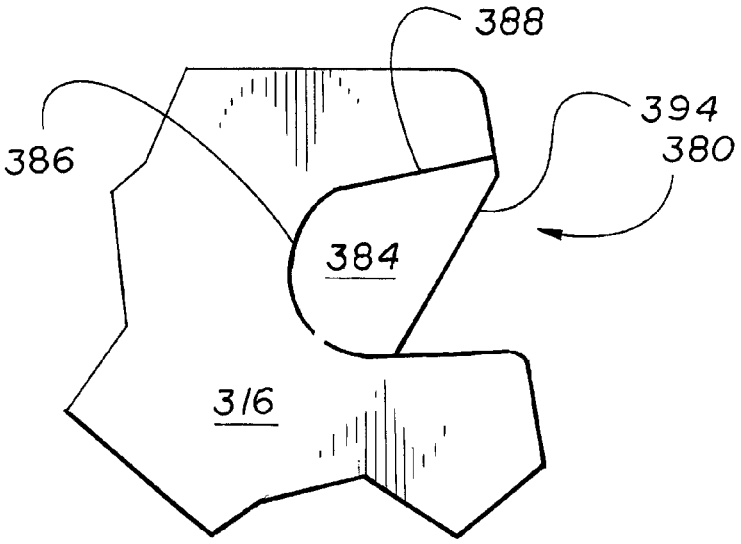
FIG. 13 is an enlarged fragmentary view of a handle reinforcing arrangement of a carton of the fourth embodiment according to the present disclosure.
Figure 14:
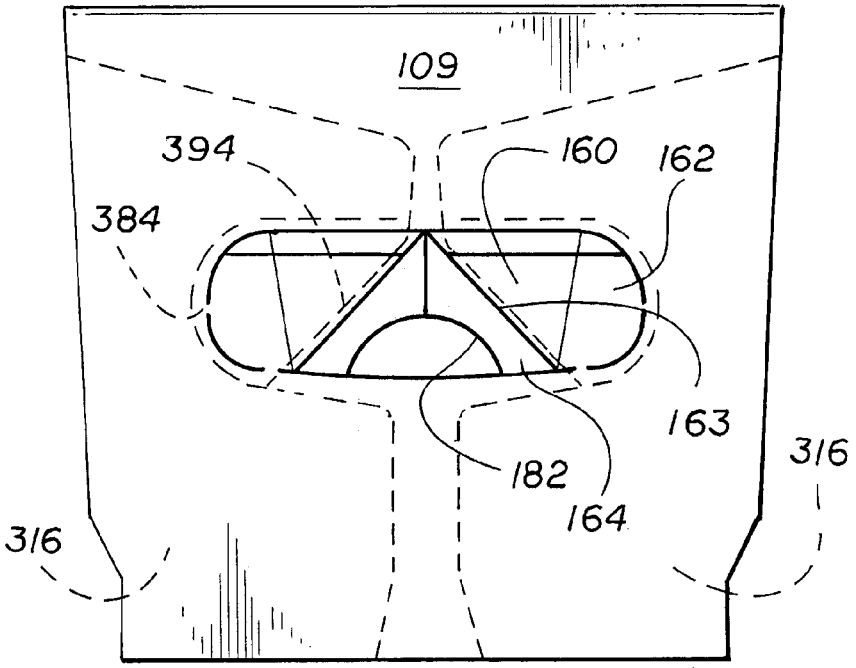
FIG. 14 is a fragmentary end view of the carton of the fourth embodiment, the carton having been formed using the handle reinforcing arrangement of FIG. 13.

FIGS. 13 and 14 illustrate a fourth embodiment of the carton of the present disclosure. The fourth embodiment differs from the second embodiment in that the handle reinforcing arrangements 380 are provided with an angled free side edge 394 respectively. The reference numerals in the fourth embodiment are increased by '300', as compared to those in the first embodiment to show that they represent features of the fourth embodiment except those features identical to the second embodiment. Those features of the fourth embodiment that are identical to those of the second embodiments are denoted by the reference numerals identical to the corresponding features of the second embodiments.

Referring to FIG. 13, the reinforcing flap 384 has an angled free side edge 394 extending from the fold line 388, or other wise a position proximate the fold line 388, to the lower end of the reinforcing flap 384. In other words, a large-sized cutout is defined in the reinforcing flap 384 in this embodiment. Upon assembly of a carton, the angled free side edge 394 is placed in substantial alignment with the divergent fold line 163 as shown in FIG. 14.

While the invention has been described for the illustrated cartons having the slot handles at the ends of the respective carton, and the hand flaps when moved inward provides clearance around a single bottle neck, it should be realized that the invention may be practiced at locations other than the ends of the respective carton, and depending on the size of the article, the type of the article and the slot handle, the slot handle may be designed to provide clearance around more than one article.

What is claimed is:

1. A carton for a plurality of articles, the carton comprising a plurality of carton walls, at least one of the carton walls including a slot handle that comprises at least one foldable hand flap, the at least one foldable hand flap comprising an article receiving section for receiving a portion of an article in the carton when the at least one foldable hand flap is folded inwardly of the carton, wherein the at least one foldable hand flap comprises a pair of intermediate panel sections which are hingedly connected to the at least one of the cartoon walls, and the article receiving section comprises a pair of yieldable tabs which are hingedly connected to the intermediate panel sections respectively, wherein the intermediate panel sections are hingedly connected to the at least one of the cartoon walls along at least one fold line, and the yieldable tabs are hingedly connected to the intermediate panel sections along a pair of divergent fold lines extending away from the at least one fold line, wherein the yieldable tabs each has a concaved free edge at a position opposing a respective one of the divergent fold lines, the concaved free edges of the yieldable tabs together define a cutout for receiving a portion of an article in the carton.

2. A carton for a plurality of articles, the carton comprising a plurality of carton walls, at least one of the carton walls including a slot handle that comprises at least one foldable hand flap, the at least one foldable hand flap comprising an article receiving section for receiving a portion of an article in the carton when the at least one foldable hand flap is folded inwardly of the carton, wherein the at least one foldable hand flap comprises a pair of intermediate panel sections which are hingedly connected to the at least one of the cartoon walls, and the article receiving section comprises a pair of yieldable tabs which are hingedly connected to the intermediate panel sections respectively, wherein the intermediate panel sections are hingedly connected to the at least one of the cartoon walls along at least one fold line, and the yieldable tabs are hingedly connected to the intermediate panel sections along a pair of divergent fold lines extending away from the at least one fold line, wherein the yieldable tabs define a cutout for receiving a portion of an article in the carton when folded along the divergent fold lines with respect to the intermediate panel sections.

3. The carton of claim 2, wherein the carton walls include a bottom wall, a pair of opposed side walls and a pair of opposed end walls, and wherein the at least one of the carton walls comprises one or more of the opposed side walls and the opposed end walls.

4. The carton of claim 2, wherein each of the divergent fold lines is disposed at an angle with respect to the at least one fold line.

5. The carton of claim 2, wherein the at least one fold line comprises a pair of primary and secondary fold lines disposed substantially parallel to each other to define a cushion panel therebetween.

6. The carton of claim 2 wherein the yieldable tabs are disposed next to each other and separated by a severance line.

7. The carton of claim 2, wherein the yieldable tabs are disposed next to each other and separated by a severance line extending generally perpendicularly to the at least one fold line.

8. The carton of claim 2, wherein the at least one foldable hand flap further comprises a pair of end panel sections hingedly connected to the intermediate panel sections along fold lines respectively.

9. The carton of claim 2, wherein the at least one of the carton walls comprises inner and outer overlapping end flaps, and the at least one foldable hand flap is formed from part of the outer end flaps.

10. The carton of claim 9, wherein the slot handle further comprises at least one foldable reinforcing flap formed from part of the inner end flap, the at least one reinforcing flap being disposed in an overlapping arrangement with the at least one foldable hand flap.

11. The carton of claim 10, wherein the article receiving section further comprises a cutout defined in the at least one reinforcing flap.

12. The carton of claim 10, wherein the article receiving section further comprises a foldable tab hingedly connected to the at least one reinforcing flap.

13. The carton of claim 12, wherein the foldable tab is hingedly connected to the at least one reinforcing flap along an angled fold line that is in substantial alignment with one of the divergent fold lines of the yieldable tabs.

14. The carton of claim 10, wherein the at least one reinforcing flap has an angled free side edge that is in substantial alignment with one of the divergent fold lines of the yieldable tabs.

15. A carton for a plurality of articles, the carton comprising a plurality of carton walls, at least one of the carton walls including a slot handle that comprises at least one foldable hand flap, the at least one foldable hand flap comprising an article receiving section for receiving a portion of an article in the carton when the at least one foldable hand flap is folded inwardly of the carton, wherein the at least one foldable hand flap comprises a pair of intermediate panel sections which are hingedly connected to the at least one of the cartoon walls, and the article receiving section comprises a pair of yieldable tabs which are hingedly connected to the intermediate panel sections respectively, wherein the intermediate panel sections are hingedly connected to the at least one of the carton walls along at least one fold line, and the yieldable tabs are hingedly connected to the intermediate panel sections along a pair of divergent fold lines extending away from the at least one fold line, wherein the at least one of the carton walls comprises inner and outer overlapping end flaps, and the at least one foldable hand flap is formed from part of the outer end flaps, wherein the slot handle further comprises at least one foldable reinforcing flaps formed from part of the inner end flap, the at least one reinforcing flap being disposed in an overlapping arrangement with the at least one foldable hand flap, wherein the at least one reinforcing flap has an angled free side edge that is in substantial alignment with one of the divergent fold lines of the yieldable tabs.

* * * * *